US007493741B1

(12) United States Patent
Chiu Chen

(10) Patent No.: US 7,493,741 B1
(45) Date of Patent: Feb. 24, 2009

(54) STRUCTURE OF A TAPE APPLYING DEVICE OF A BOX SEALING MACHINE

(75) Inventor: Tuan-Mei Chiu Chen, Chia Yi Hsien (TW)

(73) Assignee: Tien Heng Machinery Co., Ltd., Chia Yi Hsien (TW)

( * ) Notice: Subject to any disclaimer, the term of this patent is extended or adjusted under 35 U.S.C. 154(b) by 0 days.

(21) Appl. No.: 11/898,385

(22) Filed: Sep. 12, 2007

(51) Int. Cl.
*B65B 61/00* (2006.01)

(52) U.S. Cl. ..... 53/136.4; 53/419; 53/589; 156/468; 156/522; 493/117

(58) Field of Classification Search ..... 53/136.4, 53/415, 389.4, 589.2, 389.3, 419, 484; 156/468, 156/522; 493/117
See application file for complete search history.

(56) References Cited

U.S. PATENT DOCUMENTS 4,061,526 A * 12/1977 Warshaw et al. ..... 53/136.4
4,889,581 A * 12/1989 Ulrich et al. ..... 53/133.3
5,121,586 A * 6/1992 Focke ..... 53/136.4
5,184,997 A * 2/1993 James et al. ..... 493/117
5,615,531 A * 4/1997 Nakai et al. ..... 53/136.4
5,735,101 A * 4/1998 Shing-Tak Lam ..... 53/136.1
6,276,112 B1 * 8/2001 Mori et al. ..... 53/136.4

* cited by examiner

*Primary Examiner*—Hemant M Desai
(74) *Attorney, Agent, or Firm*—Rosenberg, Klein & Lee

(57) ABSTRACT

A tape applying device includes a plate, front and rear swinging arms pivoted on the plate, a pressing wheel pivoted on each of the swinging arms to make an adhesive tape stick on a box, a connecting rod pivoted to both the front and the rear swing arms, a cutting mechanism interposed between the front and the rear swinging arms to sever the adhesive tape, a first restoring extension spring joined to the connecting rod, and a second restoring extension spring joined to the rear swinging arm; the front swinging arm is co-movable with the rear swinging arm and the connecting rod, and it has no extension spring directly connected thereto therefore the front pressing wheel won't produce such a reacting force as to cause a box to cave in when the box is moved rapidly onto the front pressing wheel for the adhesive tape to stick thereon.

3 Claims, 7 Drawing Sheets

STRUCTURE OF A TAPE APPLYING DEVICE OF A BOX SEALING MACHINE

BACKGROUND OF THE INVENTION

1. Field of the Invention

The present invention relates to a tape applying device of a box sealing machine, more particularly one, which can prevent boxes from caving in when the boxes are moved through the device in sequence at a high speed for adhesive tapes to stick thereon.

2. Brief Description of the Prior Art

To save labor and time, factories usually use box sealing apparatuses to seal upper openings of boxes after products are positioned in the boxes. A common box sealing apparatus includes upper and lower tape applying devices, which are used to apply adhesive tapes to a pair of upper shutters, and a pair of lower shutters respectively.

Shown in FIGS. 5 and 6 is a tape applying device of a box sealing apparatus, which was developed by the inventor of the present invention, and includes a pair of plates (a1) and (a2), a front pressing wheel mechanism (a3) interposed between and joined to front ends of the plates (a1) and (a2), a rear pressing wheel mechanism (a4) interposed between and joined to rear ends of the plates (a1) and (a2), a cutting mechanism (a5) to sever an adhesive tape, several rollers (a6) to guide the adhesive tape, and a connecting rod (a8) pivoted to both the front and the rear pressing wheel mechanisms (a3) and (a4). The adhesive tape is passed over a front pressing wheel of the front pressing wheel mechanism (a3). When a box is conveyed through the tape applying device, the front pressing wheel will be pressed against the box in order for the adhesive tape to stick to the box. At the same time, a rear pressing wheel of the rear pressing wheel mechanism (a4) will also be pressed against the box to help to make the adhesive tape stick to the box closely. The cutting mechanism (a5) has a cutter (a51), which will swing downwards rapidly to sever the adhesive tape as soon as the box is moved away from the tape applying device. Furthermore, the plate (a2) has a smaller size than the plate (a1) such that a gap (a7) is provided on the tape applying device to face the front pressing wheel mechanism (a3), the cutting mechanism (a5), and the rollers (a6). Consequently, the front pressing wheel mechanism (a3), the cutting mechanism (a5), and the rollers (a6) are exposed to allow the technicians/operators to eliminate hitches/set an adhesive tape/observe operation of the tape applying device with ease.

Referring to FIG. 7 as well, the connecting rod (a8) and the front pressing wheel mechanism (a3) are connected to extension springs (a9); thus, when a box is passed through the tape applying device, the front pressing wheel mechanism (a3) will be forced to retreat by the box, and make the adhesive tape stick to the box. At the same time, the front pressing wheel mechanism (a3) will make the rear pressing wheel mechanism (a4) retreat through the connecting rod (a8). However, because the front pressing wheel mechanism (a3) is connected to the extension springs (a9), it will exert a reacting force on the box, which can cause the box to cave in, when the box is moved onto the front pressing wheel mechanism (a3). Consequently, appearance of the box is spoiled, and the adhesive tape can't stick on the box closely. And, boxes have to be moved through the tape applying device at a relatively low speed, otherwise a large proportion of the boxes will cave in. In other words, the factory isn't allowed to speed up the box sealing apparatus in order to increase output per unit of time.

In addition, because the extension springs (a9) of the connecting rod (a8) have a great length and diameter, the distance between the plates (a1) and (a2) is relatively big in order for the extension springs (a9) to move smoothly. Therefore, the tape applying device can't be used with those boxes that have a small breadth.

SUMMARY OF THE INVENTION

It is a main object of the present invention to provide an improvement on a tape applying device of a box sealing machine to overcome the above problems.

A tape applying device according to an embodiment of the present invention includes a plate, and front and rear pressing wheel mechanisms. The pressing wheel mechanisms each include a swinging arm pivoted on the plate, and a pressing wheel pivoted on the swinging arm to make an adhesive tape stick on a box. The tape applying device further includes a connecting rod pivoted to both the front and the rear swing arms, a cutting mechanism interposed between the front and the rear pressing wheel mechanisms to sever the adhesive tape, an extension spring joined to the rear swinging arm, and an extension spring set joined to the connecting rod, which includes several extension springs connected in series. The front swinging arm is co-movable with the rear swinging arm and the connecting rod, and it has no extension spring directly connected thereto. Therefore, the front pressing wheel mechanism won't produce such a reacting force as to cause a box to cave in when the box is rapidly moved onto the front pressing wheel. Consequently, the adhesive tape can stick on the box closely. And, the tape applying device allows more boxes to be conveyed through it in sequence per unit of time.

BRIEF DESCRIPTION OF THE DRAWINGS

The present invention will be better understood by referring to the accompanying drawings, wherein.

DETAILED DESCRIPTION OF THE PREFERRED EMBODIMENTS

Figure 1:
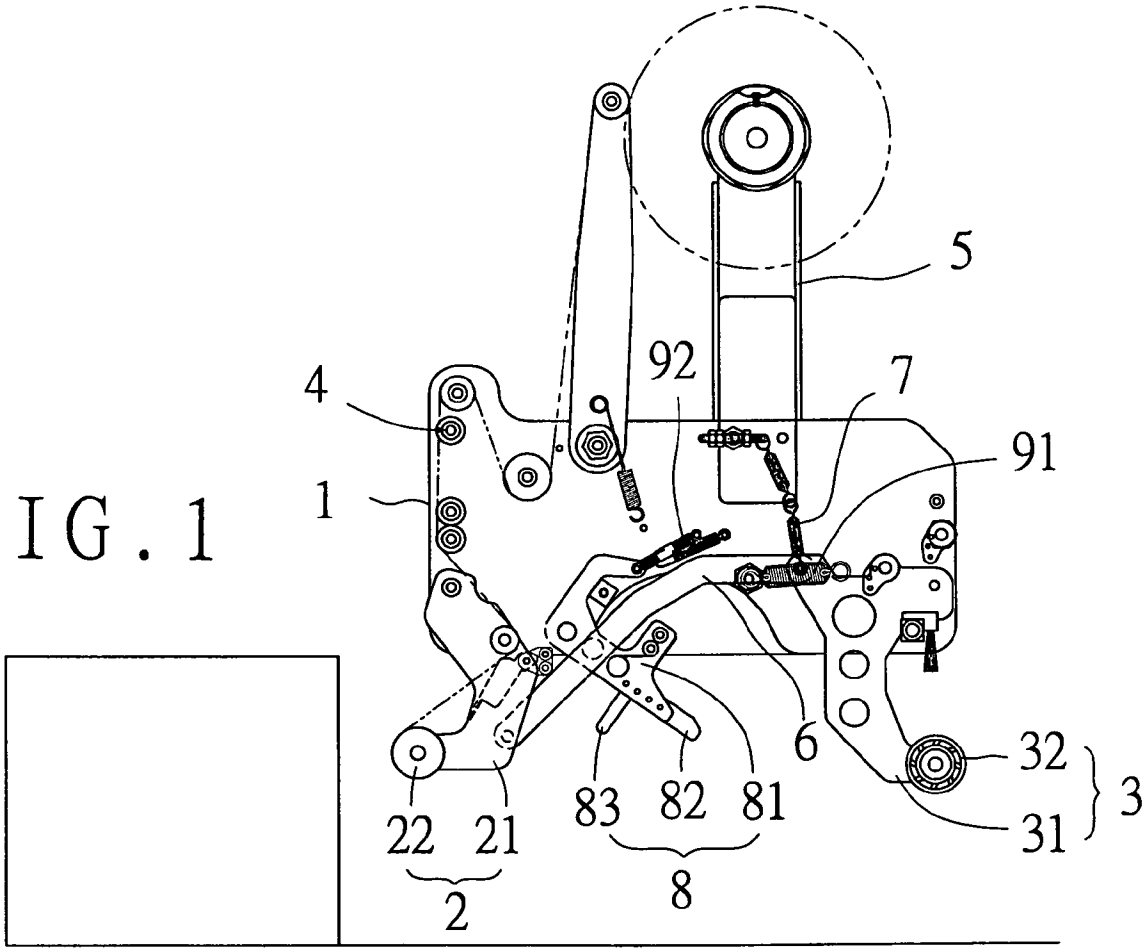
FIG. 1 is a side view of the present invention.
Figure 3:
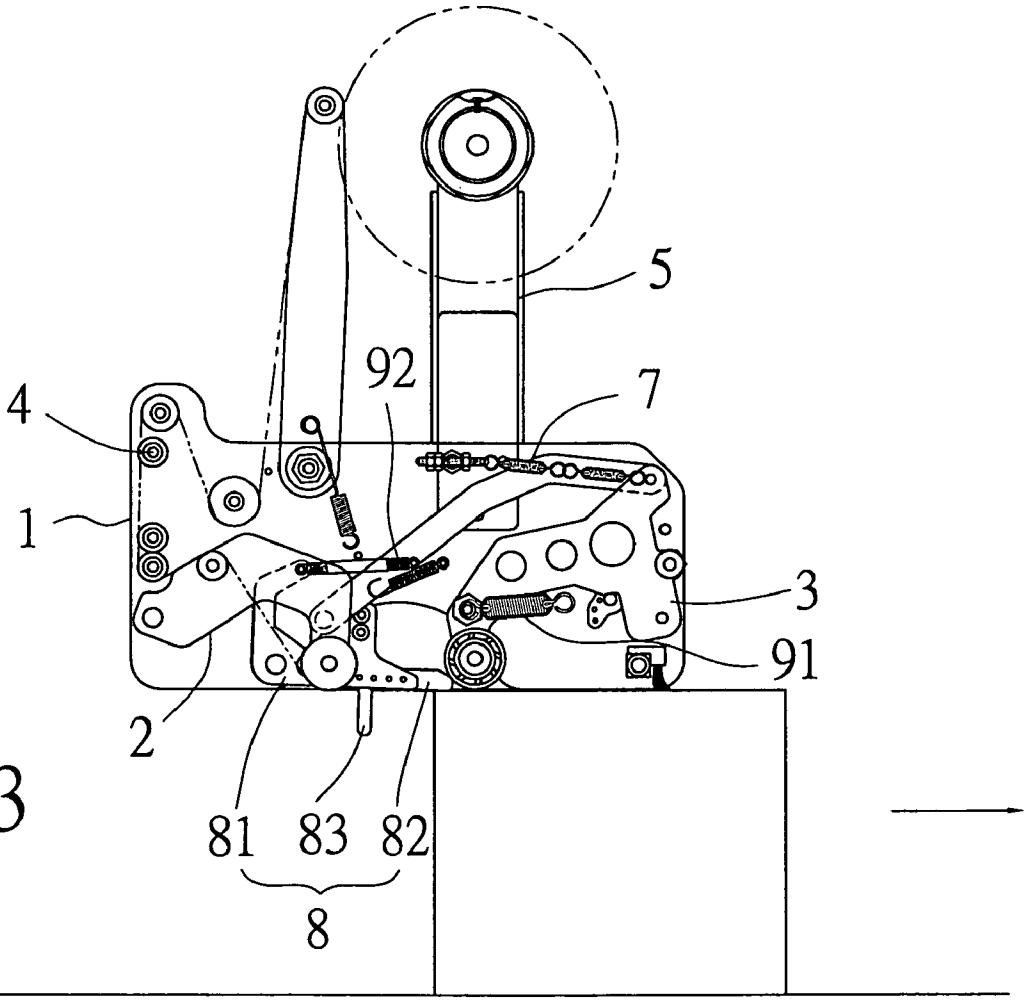
FIG. 3 is a view of the present invention being in use (2)

Referring to FIG. 1, a preferred embodiment of a tape applying device of a box sealing machine of the present invention includes:

two plates 1 facing each other;

a front pressing wheel mechanism 2 interposed between front ends of the plates 1; the front pressing wheel mechanism 2 includes a swinging arm 21, which is pivoted to the front ends of the plates 1; the front pressing wheel mechanism 2 includes a front pressing wheel 22 pivoting on the swinging arm 21;

a rear pressing wheel mechanism 3 interposed between rear ends of the plates 1; the rear pressing wheel mechanism 3 includes a swinging arm 31, which is pivoted to the rear ends of the plates 1; the rear pressing wheel mechanism 3 includes a rear pressing wheel 32 pivoting on the swinging arm 31;

a supporting member 5, which is arranged above the plates 1, and on which an adhesive tape is held;

several rollers 4, which are arranged above the front pressing wheel mechanism 2, and pivoted to the plates 1 to guide the adhesive tape;

a connecting rod 6 pivoted to both the swing arms 21 and 31 of the front and the rear pressing wheel mechanisms 2 and 3;

an extension spring set 7, which include several extension springs connected in series, and which are securely joined to the connecting rod 6 at one end, and securely joined to the plates 1 at the other end and pivotally coupled there to the swing arm 31 of the rear pressing wheel mechanism as best shown in FIG. 3;

a cutting mechanism 8, which is interposed between the front and the rear pressing wheel mechanisms 2 and 3; the cutting mechanism 8 includes a swinging arm 81, which is pivoted to the plates 1; the cutting mechanism 8 includes a cutter 82, which is joined to a tail end of the swinging arm 81; the cutting mechanism 8 includes an action arm 83, which is joined to the swinging arm 81, in front of the cutter 82;

an extension spring 91, which is securely joined to the swinging-arm 31 of the rear pressing wheel mechanism 3 at one end, and joined to the plates 1 at the other end in order to bias the rear pressing wheel mechanism 3 back to its original position; and an extension spring 92, which is securely joined to the swinging arm 81 of the cutting mechanism 8 at one end, and joined to the plates 1 at the other end in order to bias the cutting mechanism 8 back to its original position.

Figure 2:
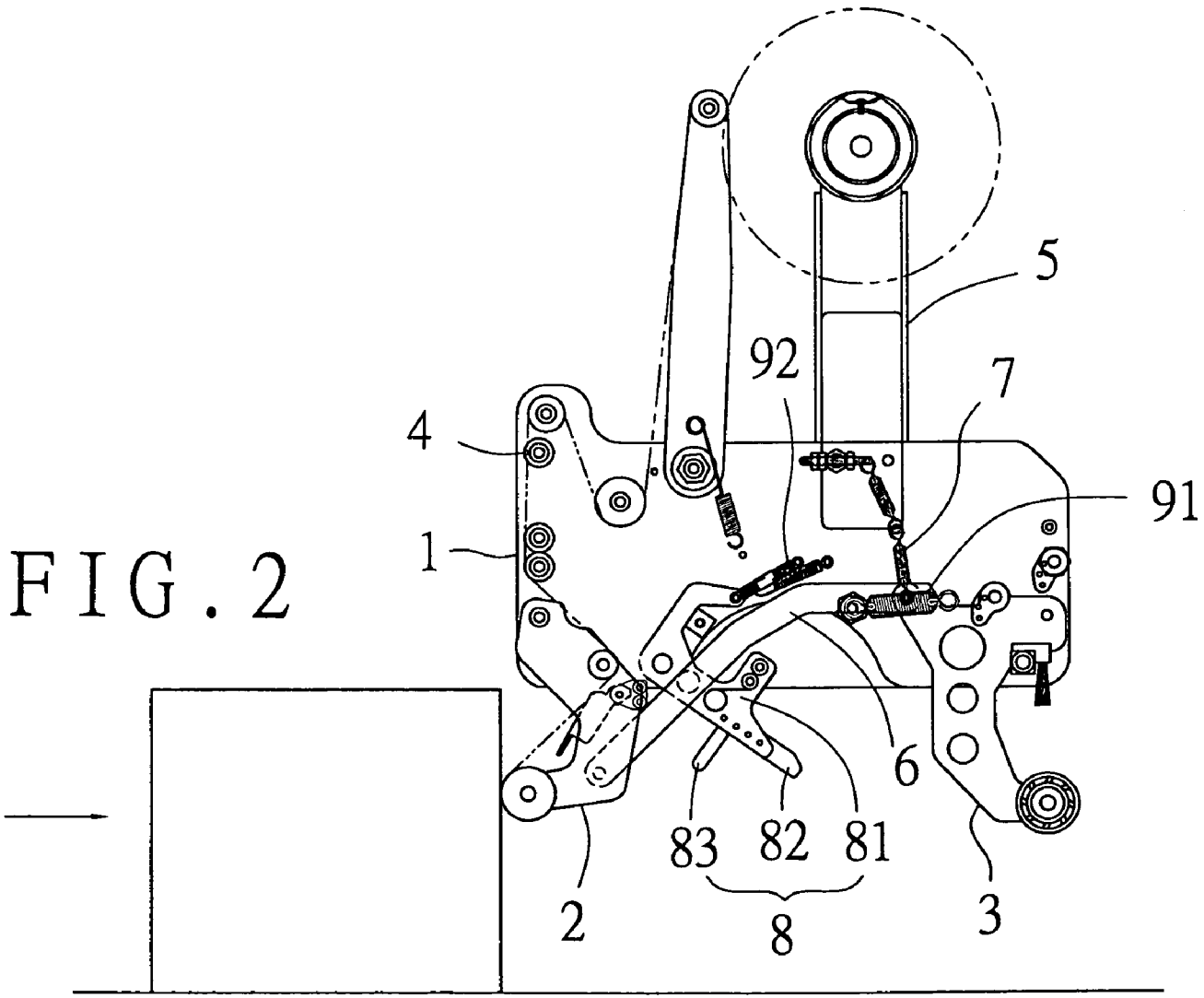
FIG. 2 is a view of the present invention being in use (1)
Figure 4:
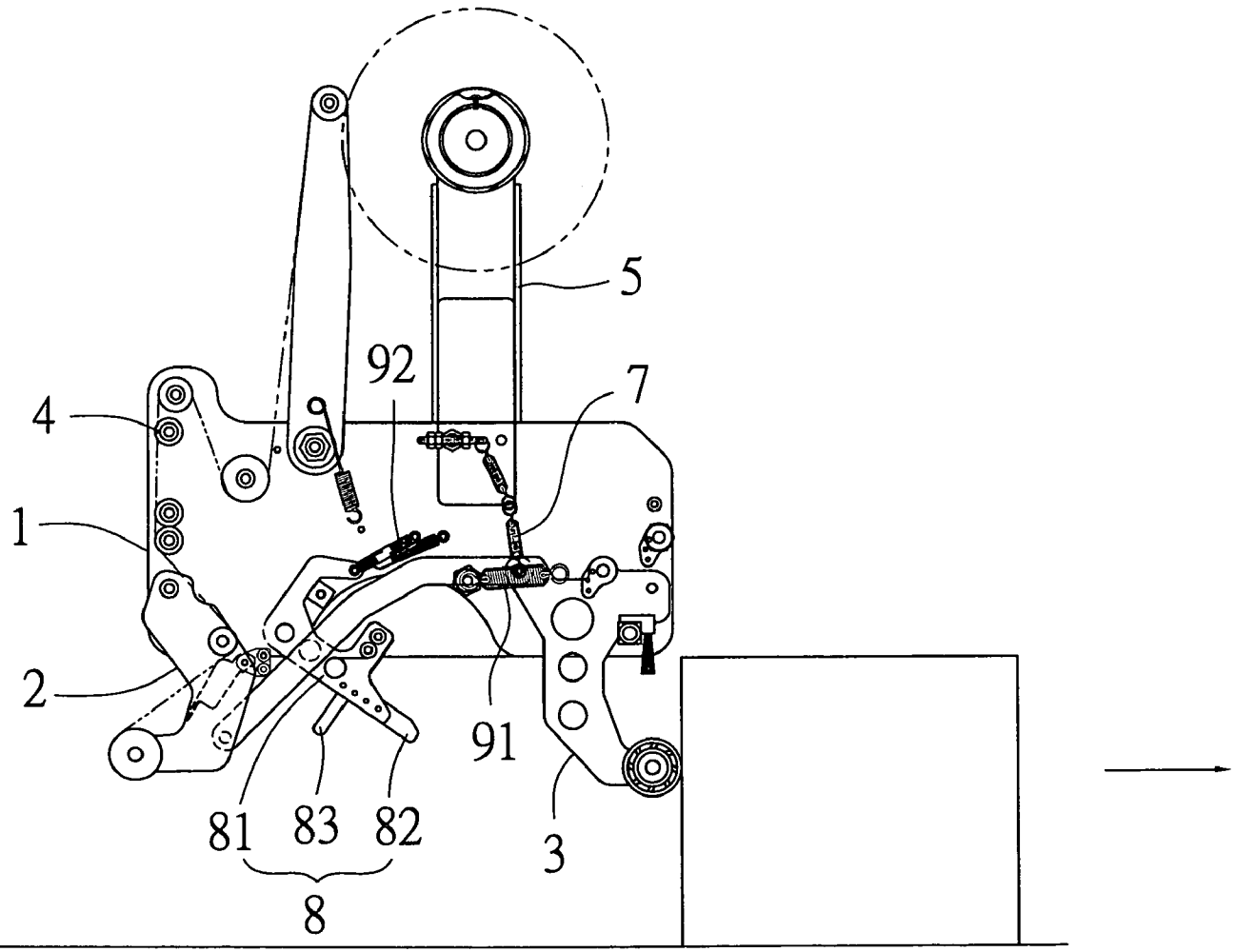
FIG. 4 is a view of the present invention being in use (3)
Figure 5:
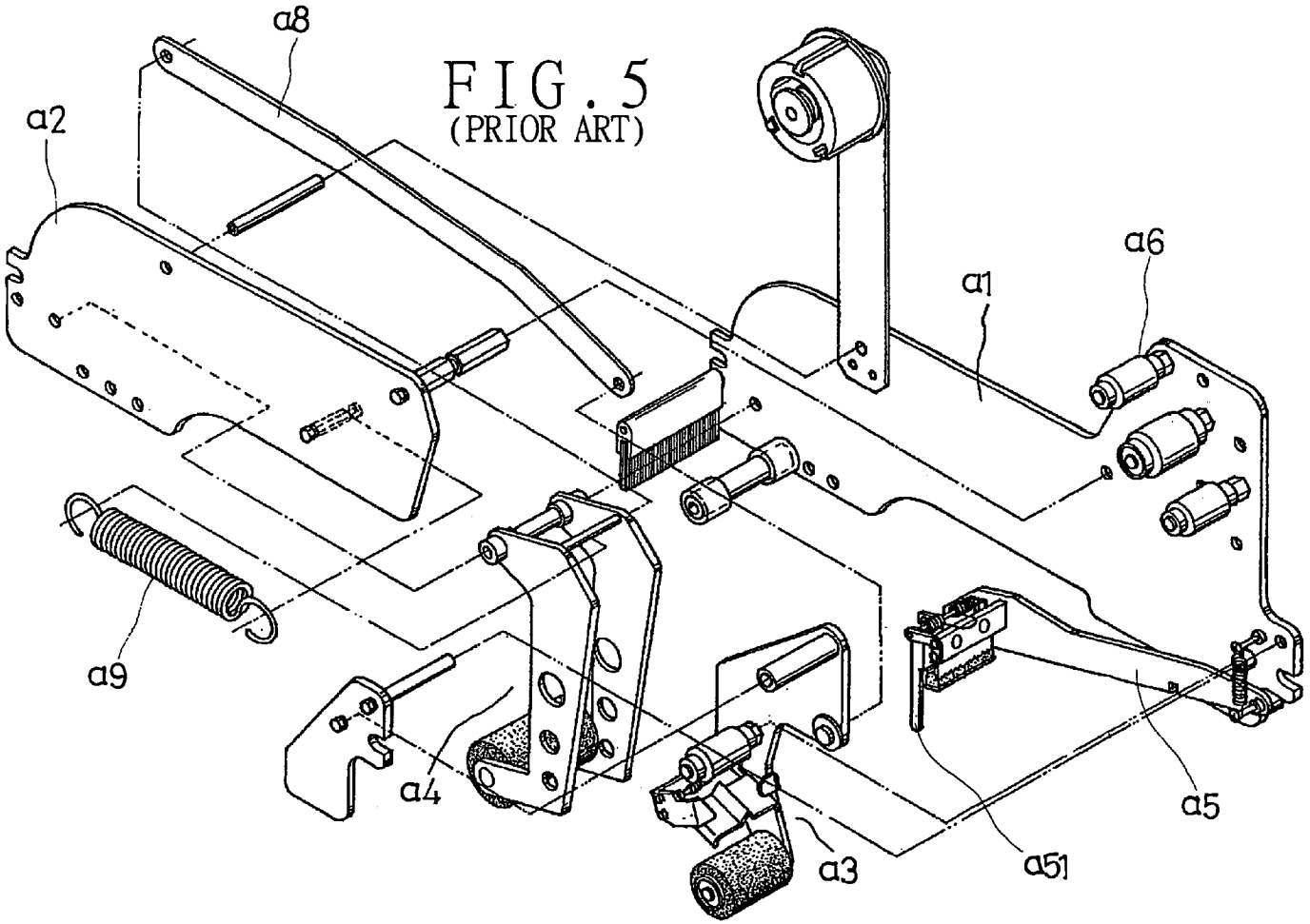
FIG. 5 (PRIOR ART)
FIG. 5 is an exploded perspective view of the prior art.
Figure 6:
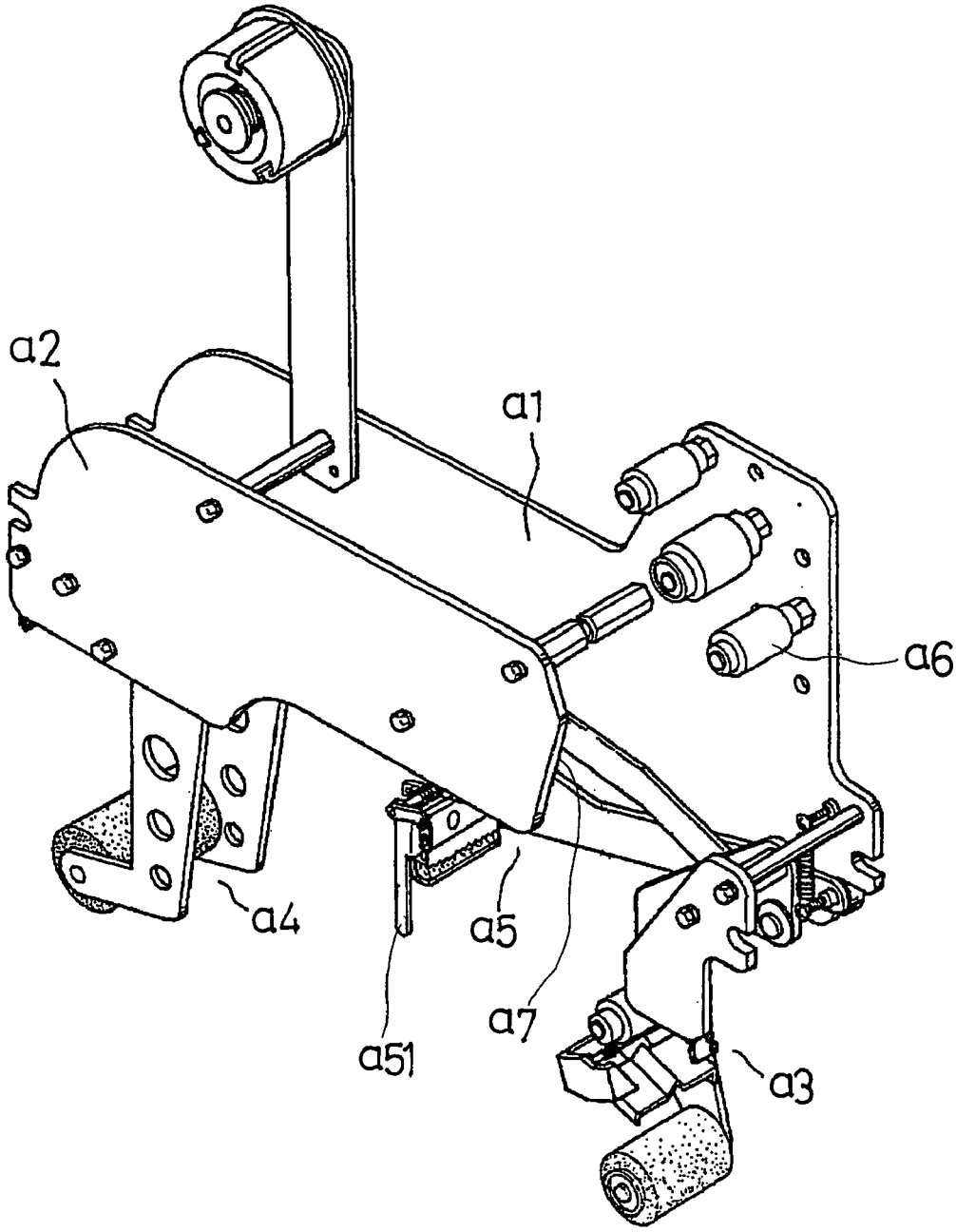
FIG. 6 (PRIOR ART)
FIG. 6 is a perspective view of the prior art.
Figure 7:
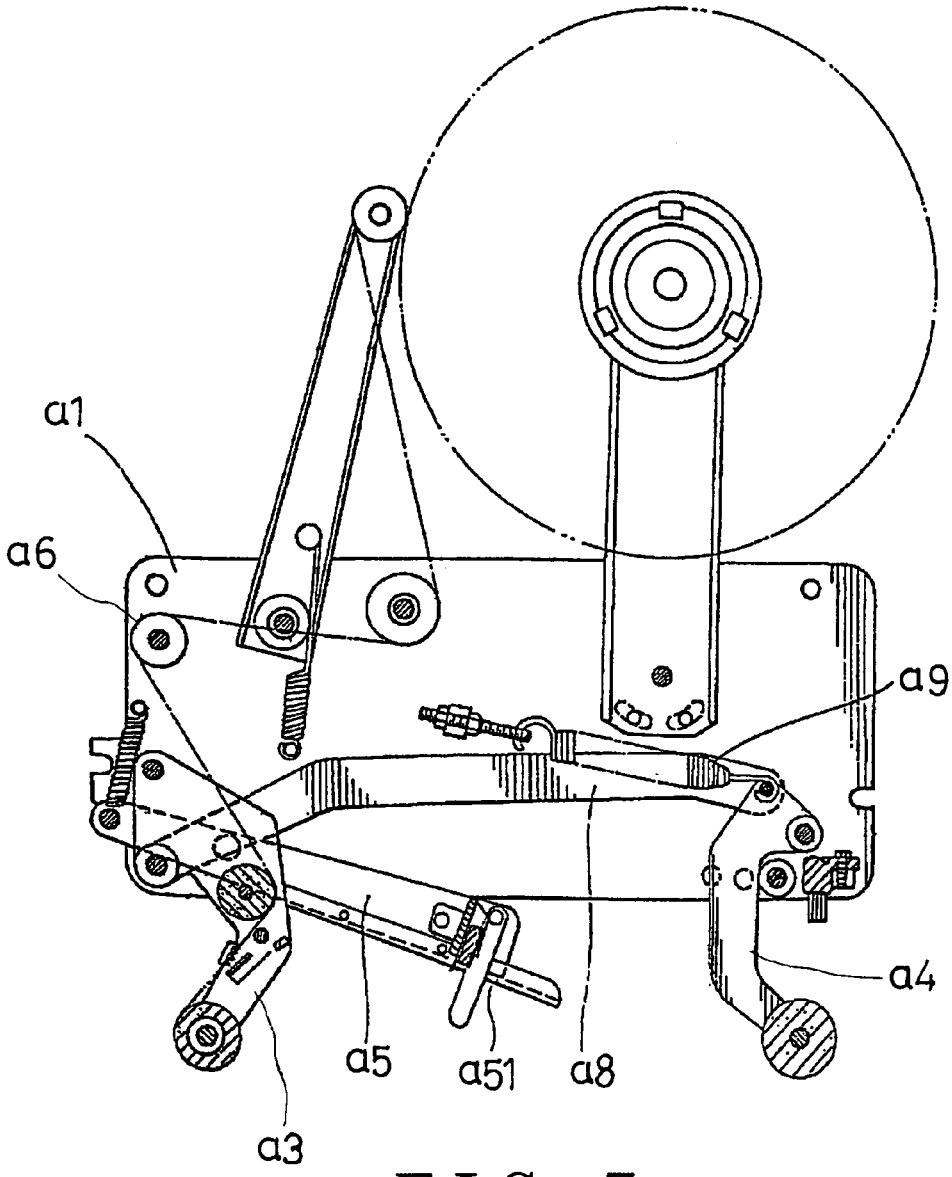
FIG. 7 (PRIOR ART)
FIG. 7 is a side view of the prior art.

In use, referring to FIG. 2, when a box is conveyed to the front pressing wheel mechanism 2, the adhesive tape passed over the front pressing wheel mechanism 2 will be pressed against and stick to the box; at the same time, the box will cause the front pressing wheel mechanism 2 to retreat. Referring to FIG. 3 as well, when the front pressing wheel mechanism 2 is retreating, the connecting rod 6 will pivot together with the front pressing wheel mechanism 2 so as to cause the rear pressing wheel mechanism 3 to retreat from the outwardly-sticking position into the space between the plates 1; because the front and the rear pressing wheel mechanisms 2 and 3 are in a retreating position, the adhesive tape will stick on the box in a smooth manner. Furthermore, when the box is being conveyed through the tape applying device, the box will push the action arm 83 so as to cause the cutting mechanism 8 to retreat into the space between the plates 1; thus, the extension spring 92 will make the cutter 82 of the cutting mechanism 8 stick out so as to sever the adhesive tape at a proper point of time after the box is conveyed to be apart from the tape applying device, as shown in FIG. 4. The rear pressing wheel mechanism 3 will be forced to move back to its original outwardly-sticking position by means of the extension spring 91 as soon as the box is moved away from the tape applying device; at the same time, the rear pressing wheel mechanism 3 will make the connecting rod 6 move back to its original position. Owing to the extension spring set 7, the connecting rod 6 can move more smoothly, and in turn the front pressing wheel mechanism 2 will move back to its original outwardly-sticking position rapidly in order for the adhesive tape to stick on the following box. Consequently, the tape applying device allows boxes to be conveyed through it in sequence at a higher speed.

No extension spring is directly connected to the front pressing wheel mechanism 2 while the connecting rod 6 pivoted to both the front and the rear pressing wheel mechanisms 2 and 3 is biased by means of the extension spring set 7, and the rear pressing wheel mechanism 3 is biased by means of the extension spring 91. Therefore, the front pressing wheel mechanism 2 can't produce such a reacting force as to cause a box to cave in when the box is being rapidly moved onto the front pressing wheel mechanism 2 to cause the front pressing wheel mechanism 2 to retreat into the space between the plates 1. Consequently, the box has a flat surface, and the adhesive tape is allowed to closely stick on the box to seal the box.

In addition, the extension springs 91 and 92, and the extension spring set 7 have a relatively small diameter, which allows the distance between the plates 1 to be reduced; thus, the tape applying device can be used to apply adhesive tape on boxes of smaller breadth. The extension springs 91 and 92 are relatively short, yet the extension spring set 7 comprise several extension springs connected in series to ensure that the connecting rod 6 is subjected to enough pulling force.

From the above description, it can be seen that the tape applying device of the present invention has the following advantages:

1. No extension spring is directly connected to the front pressing wheel mechanism while the extension springs directly connected to the connecting rod and the rear wheel mechanism provide the force to move the connecting rod, the front and the rear pressing wheel mechanisms back to their outwardly-sticking position. Therefore, the front pressing wheel mechanism can't produce such a reacting force as to cause a box to cave in when the box is moved rapidly onto the front pressing wheel mechanism.

2. The connecting rod will move more smoothly, and the front pressing wheel mechanism can return to its original position relatively rapidly because of the extension spring set comprising several extension springs connected in series. Consequently, the tape applying device can work more efficiently.

3. The extension springs of the cutting mechanism and the rear pressing wheel mechanism, and the extension spring set of the connecting rod have a relatively small diameter. Therefore, the distance between the plates reduces, and the tape applying device can be used to apply adhesive tape on boxes of smaller breadth.

4. The extension spring set of the connecting rod comprises several extension springs connected in series therefore they are less likely to get fatigued. Consequently, the extension spring set will last for a longer length of time, and it will take relatively little labor and time to maintain the tape applying device.

What is claimed is:

1. A tape applying device structure of a box sealing machine, comprising:

a plate;

a front pressing wheel mechanism, the front pressing wheel mechanism including a swinging arm pivoted to a front end of the plate; the front pressing wheel mechanism including a front pressing wheel pivoting on the swinging arm;

a rear pressing wheel mechanism, the rear pressing wheel mechanism including a swinging arm pivoted to a rear end of the plate; the rear pressing wheel mechanism including a rear pressing wheel pivoting on the swinging arm thereof;

a plurality of rollers arranged above the front pressing wheel mechanism, and pivoted to the plate to guide an adhesive tape held on a supporting member arranged above the plate;

a connecting rod pivoted to both the swing arms of the front and the rear pressing wheel mechanisms;

a cutting mechanism interposed between the front and the rear pressing wheel mechanisms to sever the adhesive tape;

a first extension spring set joined to the connecting rod and to the swinging arm of the rear pressing wheel mechanism at one end, and joined to the plate at other end thereof, the first extension spring set including a plurality of extension springs connected in series; and a second extension spring joined to the swinging arm of the rear pressing wheel mechanism at one end, and joined to the plate at other end thereof.

2. The tape applying device structure of a box sealing machine as claimed in claim 1, wherein the cutting mechanism includes:

a swinging arm pivoted to the plate;

a cutter joined to a tail end of the swinging arm; and an action arm joined to the swinging arm, in front of the cutter;

an extension spring being joined to the swinging arm of the cutting mechanism at one end, and joined to the plate at other end thereof.

3. The tape applying device structure of a box sealing machine as claimed in claim 1, wherein the first extension spring includes a pair of the extension springs of lesser diameter than said second extension spring connected in series.

* * * * *